US006736285B2

(12) United States Patent
Stewart-Stand

(10) Patent No.: US 6,736,285 B2
(45) Date of Patent: May 18, 2004

(54) COLLAPSIBLE DRINKING AND STORAGE RECEPTACLE

(76) Inventor: Theo A. Stewart-Stand, 230 Park Pl., Brooklyn, NY (US) 11238

( * ) Notice: Subject to any disclaimer, the term of this patent is extended or adjusted under 35 U.S.C. 154(b) by 0 days.

(21) Appl. No.: 10/353,864

(22) Filed: Jan. 29, 2003

(65) Prior Publication Data

US 2003/0160055 A1 Aug. 28, 2003

Related U.S. Application Data

(60) Provisional application No. 60/353,616, filed on Feb. 1, 2002.

(51) Int. Cl.[7] ..... B65D 25/08
(52) U.S. Cl. ..... 220/666; 206/218
(58) Field of Search ..... 220/666; 206/218

(56) References Cited

U.S. PATENT DOCUMENTS

| | | | | | |
|---|---|---|---|---|---|
| 2,723,779 | A | | 11/1955 | Parker | |
| 2,886,084 | A | * | 5/1959 | Davison | 220/666 |
| 3,434,589 | A | * | 3/1969 | Valtri et al. | 206/218 |
| 4,058,995 | A | * | 11/1977 | Greaves | 70/431 |
| 4,865,211 | A | | 9/1989 | Hollingsworth | |
| 4,875,576 | A | * | 10/1989 | Torgrimson et al. | 206/219 |
| 5,439,125 | A | | 8/1995 | Bloch | |

* cited by examiner

*Primary Examiner*—Joseph Man-Fu Moy
(74) *Attorney, Agent, or Firm*—Herbert Dubno

(57) ABSTRACT

A collapsible container such as a drinking cup has a disk-shaped bottom and a disk-shaped cover which fit one within the other and engage by catches. A molded inner cup body has its base connected to the bottom and a mouth surrounded with a ring which seals to the cover and springs up from the bottom to erect the cup when the catches are released.

14 Claims, 7 Drawing Sheets

FIG. 6
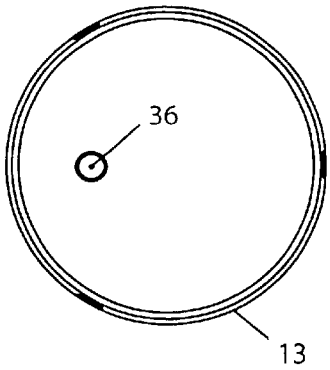
FIG. 4
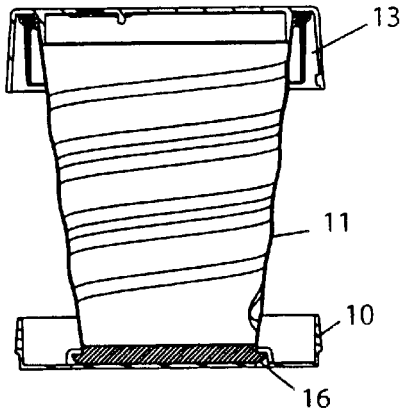
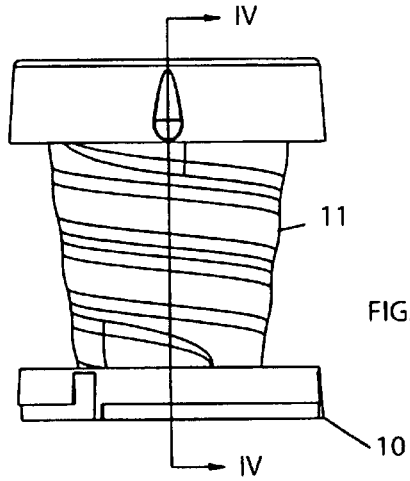
FIG.1
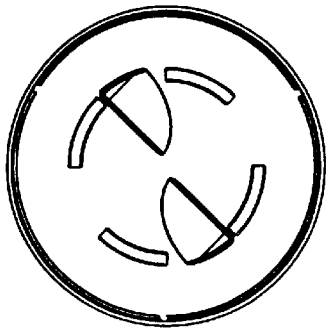
FIG. 5

COLLAPSIBLE DRINKING AND STORAGE RECEPTACLE

CROSS REFERENCE TO RELATED APPLICATION

This application is related to provisional application No. 60/353,616 filed Feb. 1, 2002.

FIELD OF THE INVENTION

My present invention relates to a collapsible drinking and/or storage receptacle and, more particularly, to a drinking cup or like vessel which can be collapsed to a substantially flat configuration.

BACKGROUND OF THE INVENTION

Collapsible drinking cups utilizing telescoping structures and conical cups with circular segments which seal relative to one another as the cup is extended are known in the art. Other collapsible receptacle configurations are known as well. Reference can be had, for example, to U.S. Pat. No. 4,865,211 which relates to a collapsible bottle in which the bottle wall inverts as the bottle is collapsed or has one section of larger diameter adopted to fit over a section of smaller diameter and connected continuously thereto. The bottle is made from plastic.

That patent discusses other container geometries which permit collapsing and extension of the container, including U.S. Pat. No. 2,880,902 which utilizes a bellows construction for a drinking cup. A tubular plastic container having spiral ridges is disclosed in U.S. Pat. No. 2,723,779, also mentioned in U.S. Pat. No. 4,865,211, and a number of other foldable or collapsible container designs are mentioned in that patent as well.

Reference may also be had to a drinking tube and container system which permits collapsing of the structure and to baby bottle designs which are collapsible (see U.S. Pat. No. 5,439,125 and the earlier patents described or mentioned therein).

Notwithstanding the considerable art with respect to collapsible containers, there remains the need for a collapsible container which is stable, reliably sealable, compact in its collapsed or contracted position and capable of extension or expansion into a conveniently usable receptacle for beverages and the like as well as for storage and other receptacles capable of being collapsed and effectively stored in the flattened state.

OBJECTS OF THE INVENTION

It is, therefore, the principal object of the present invention to provide a collapsible receptacle which is free from the drawbacks of earlier receptacles and containers, which can be manufactured at low cost, can be collapsed to an especially thin and flat structure, is of light weight and has an aesthetically pleasing appearance.

Another object is to provide an improved collapsible drinking cup which can be utilized repeatedly and over long periods of time without a tendency to leak, is convenient to use and can be collapsed and erected in a simple way.

It is also an object of this invention to provide an improved storage container which, when not in use, is itself capable of storage in a small space.

SUMMARY OF THE INVENTION

These objects and others which will become apparent hereinafter are attained, in accordance with the invention in a collapsible container which has a wide mouth and a small bottom and a plastic continuous membrane wall connecting the bottom with a rim of the mouth and which is collapsible so that, in the collapsed position, the mouth rim is coplanar or substantially in the same plane as the bottom. According to the invention, a resilient cup-shaped body of a silicone rubber or other shape-memory synthetic resin is provided between the rim and the bottom and can fold between the cover and the bottom disks so that it automatically can spring from its compacted position into its extended position while the membrane of the wall maintains a perfect seal between the ring defining the mouth and the bottom.

According to a feature of the invention, the cup-shaped body is formed with a helical corrugation to enable the membrane wall to collapse between the cover and bottom disk in an ordered manner.

According to another feature of the invention, the bottom of the cup is formed by or is bonded to a disk-shaped member which is engaged with another annular disk shaped member formed by or at the rim of the mouth, the two disk shaped members being interconnectable by a releasable catch which can retain the cup in its compact or contracted position.

A removable lid may span across the mouth of the cap to seal the latter in its closed position when, for example, the cup contains a beverage and the user wants to transport that beverage from one location to another.

The lid itself can be connected to the upper disk by a hinge or catch system as may be convenient. All of the parts of the cup may be composed of a synthetic resin material and can be injection molded or extruded so that the overall cost of the collapsible cup is at a minimum. The lid and bottom of the cap may be formed with a logo, design or legible matter by embossing or in the molding process or by a printing process, representing a distributor of the cup as a promotional item or otherwise.

The principles of the invention are applicable, as has been noted, to containers generally and especially to food containers such as refrigeration and storage containers which must be sealed and which must protect the food therein against loss of moisture or penetration of moisture or air into the container.

While in the case of a cup, the resilient membrane body may have a generally circular cross section, in the case of food containers, the membrane body may have a rectangular cross section or a spiral, an oval, or other cross section as may be desired.

The lid or cover of the container should be capable of sealing to the top rim of the body.

According to a feature of the invention, the lid can be removed or a straw-receiving hole in the lid can be provided to allow a beverage to be sipped through the hole.

BRIEF DESCRIPTION OF THE DRAWING

The above and other objects, features, and advantages will become more readily apparent from the following description, reference being made to the accompanying drawing in which:

FIG. 1 is an elevational view of the cup in its expanded form;

FIG. 4 is a cross sectional view through the cup as taken along line IV—IV of FIG. 1;

FIG. 5 is a bottom view of the cup;

FIG. 6 is a top view of the cup;

SPECIFIC DESCRIPTION

Figure 3:
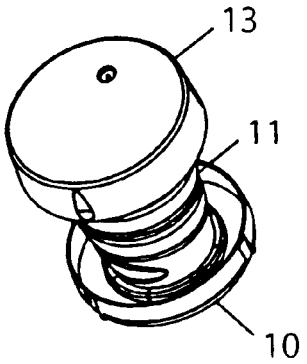
FIG. 3 is a perspective view of the cup as expanded.
Figure 2:
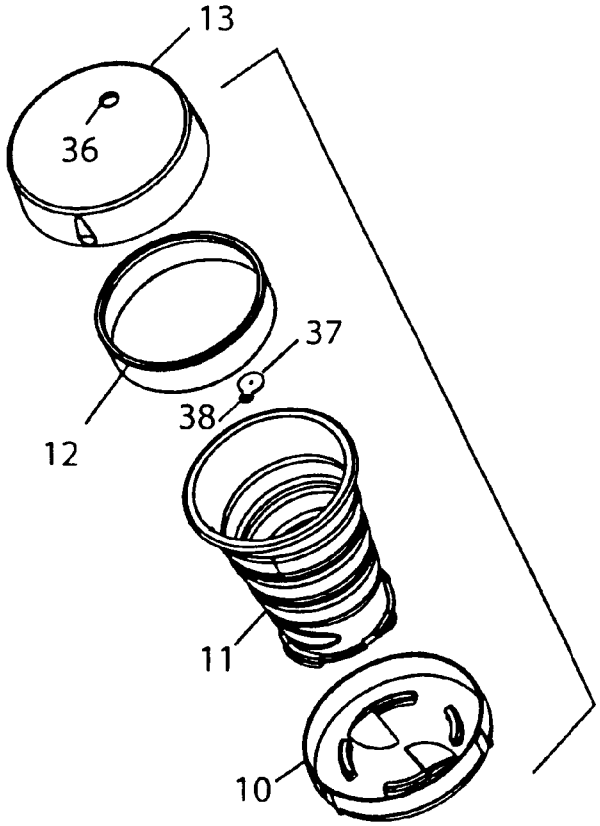
FIG. 2 is an exploded view of the cup.
Figure 7:
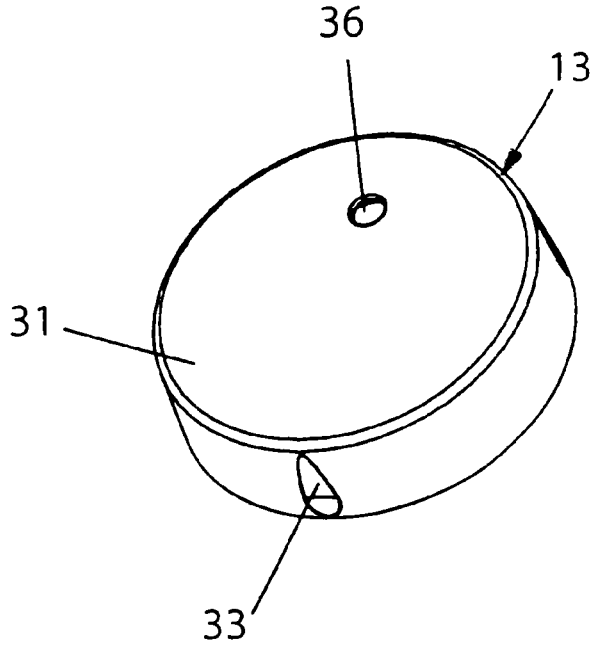
FIG. 7 is a perspective view of the cover.

The collapsible cup, whose principal elements are shown in FIGS. 1–3, comprises an upwardly round injection-molded disk-shaped bottom or base member 10, an elastic, collapsible, downwardly tapering cup-shaped member 11 of a food-compatible material such as a silicone rubber or other elastomeric, a mouth ring 12 of injection-molded synthetic resin and a disk-shaped cover 13 which is likewise injection-molded.

The expanded position of the cup is shown in FIG. 1 and its collapsed position has been illustrated in 19.

Figure 12:
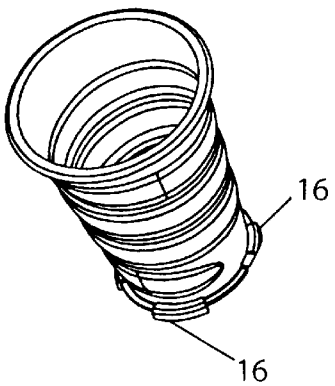
FIG. 12 is a perspective view of the collapsible internal cup member.
Figure 13:
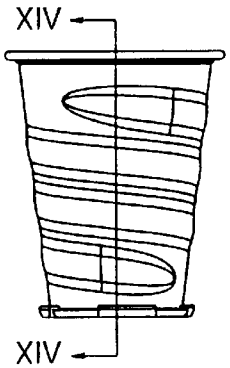
FIG. 13 is an elevational view of that member.
Figure 14:
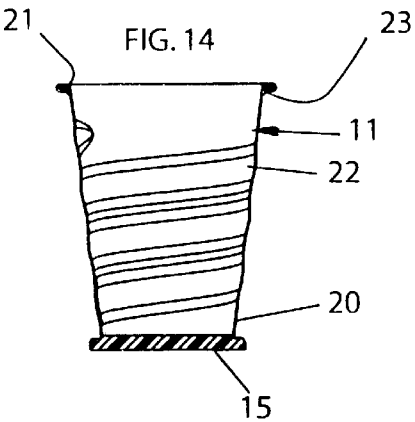
FIG. 14 is a cross sectional view taken along the lien XIV—XIV of FIG. 13.
Figure 15:
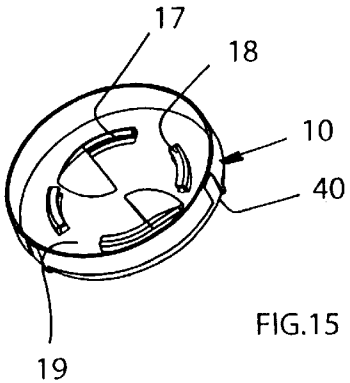
FIG. 15 is a perspective of the base.
Figure 18:
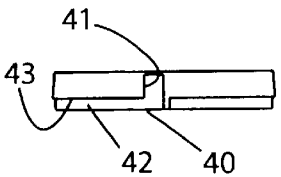
FIG. 18 is a side elevational view of the base.

As will be apparent from FIGS. 12–14, the internal cup-shaped member 11 has a relatively thick base 15 with lugs 16 spaced therearound and shaped to enable those lugs to be press-fitted into corresponding grooves 17 of an equal number of ribs 18 molded unitarily with the bottom 10 (see FIGS. 15–18), the ribs 15 being spaced apart by gaps 19 equal in circumferential length or arc length to the rib. Thus, when the lugs 16 of the base 15 are placed in the gaps 19, for assembly of the bottom 10 with the internal cup 11, the base 15 and the bottom 10 can be relatively rotated to bring the lugs 16 snugly into the grooves 17 and thereby lock the bottom 10 onto the internal cap 11.

The internal cup 11 is unitarily injection-molded with an upstanding thin wall 20 of frustoconical configuration which diverges upwardly to a mouth 21 or converges downwardly to the base 15, but is formed with a slight helical corrugation 22 which functions as a formation in this wall facilitating its ordered collapse as the mouth 21 is pressed toward the base 15. The wall 20, however, is sufficiently resilient so as to have an intrinsic spring action and in effect be an internal spring which jumps upwardly to the erect position shown in FIGS. 1 and 14 when the cover is released from the bottom.

The rim 23, molded unitarily with the wall 20, is press-fitted, on assembly over an annular shoulder 25 of the ring 12 and into an outwardly open groove 26 in this ring. The ring 12 is referred to as a mouth ring, is injection-molded with an apron 27 tapering in thickness downwardly around the outer portion of the cup 22 and serves to maintain the stability of the mouth during the collapse of that cup and for sealing with the cover.

The bottom 10, the mouth ring 12 and the cover 13 are all injection-molded from the same relatively rigid, food-approved and food-compatible material. The mouth ring is dimensioned to fit snugly around a downwardly-extending rib 30 on the underside of the cover surface 31 of the member 13 whose outer wall 32 diverges downwardly, can be provided with external formations 33 to facilitate gripping and has three angularly equispaced internal formations or bumps 34 which, as will be described in greater detail hereinafter, form part of a bayonet fastener with the bottom member. The space 35 between the rib 30 and the wall 32 thus accommodate the mouth of the internal cup formed by the ring 12 and the rim 23.

Figure 8:
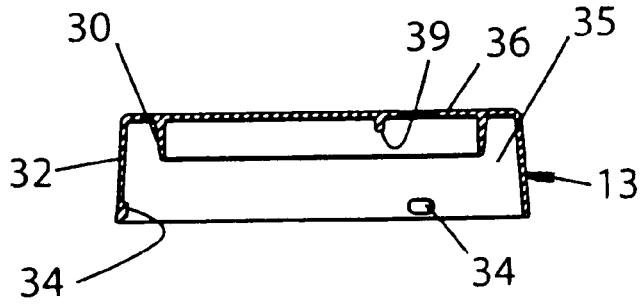
FIG. 8 is a cross section through the cover.
Figure 9:
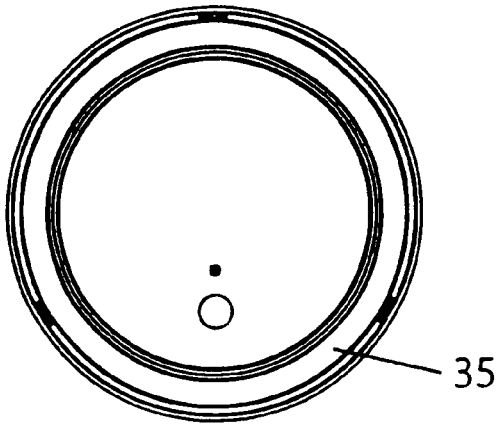
FIG. 9 is a bottom view of the cover.
Figure 10:
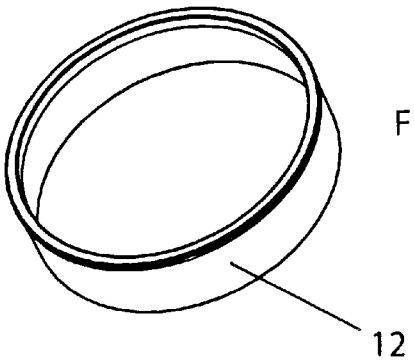
FIG. 10 is a perspective view of the mouth ring of the cup.
Figure 11:
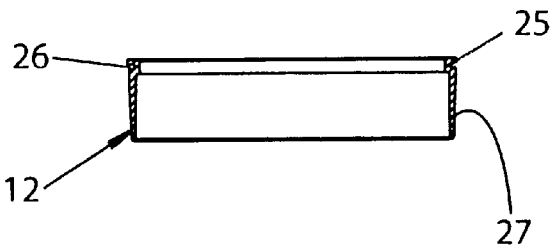
FIG. 11 is a cross sectional view of this ring.

The cover wall 30, whose external surface may be embossed or imprinted with promotional material, a corporate logo, or other legible, decorative or aesthetic material or information, can have a hole 36 which may be covered by a shutter 37 which can have an opening 38 pressed over a pin 39 (compare FIGS. 2 and 8).

The shutter 37 within the cover 13 closes the bore 36 but can be deflected by a straw upon its insertion through the hole 36.

Figure 19:
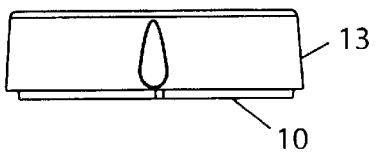
FIG. 19 is a collapsible cup.
Figure 17:
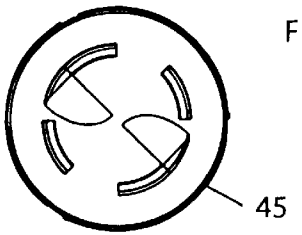
FIG. 17 is a top view of the base.
Figure 16:
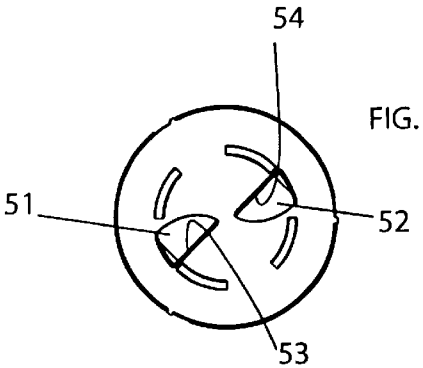
FIG. 16 is a bottom view of the base.

The base 10 is provided with three angularly-spaced bayonet formations at 40 to receive the bumps 34. These bayonet formations comprise downwardly-extending recesses 41 opening into circumferential recesses 42, below a ridge 43 formed by the downwardly and outwardly diverging flanks 44 of the side wall 45 of the bottom 10. Since the flank 44 diverges outwardly when the cover is pressed over the bottom 10, the bumps 34 slide along the flank 44 until they jump into the grooves 42 of respective bayonet formations. The result is a collapsed position seen in FIG. 19. To open the cup, the bottom 10 and the cover 13 are rotated relatively until the bumps pass into the grooves 41. Because the flank 44 is tapered in thickness upwardly, the bumps are released from the groove 41 and the bottom 10 can separate from the cover, whereupon the cup jumps into its extended position. The cover can then be removed and the cup used to imbibe a beverage. The bottom wall 50 of the cup can be formed with a pair of recesses 51, 52 with steep flanks 53 and 54 enabling gripping by the fingers of the user to facilitate relative rotation of the bottom and the cover.

The rim 23 forms a gasket which can be sealed by the cover 123 when the cover is replaced on the cup in its extended position for storage of the contents.

In the compact position the cup can have a total height about an inch or less as compared with a height of almost four inches when expanded and an overall diameter of slightly more than four inches.

Figure 20:
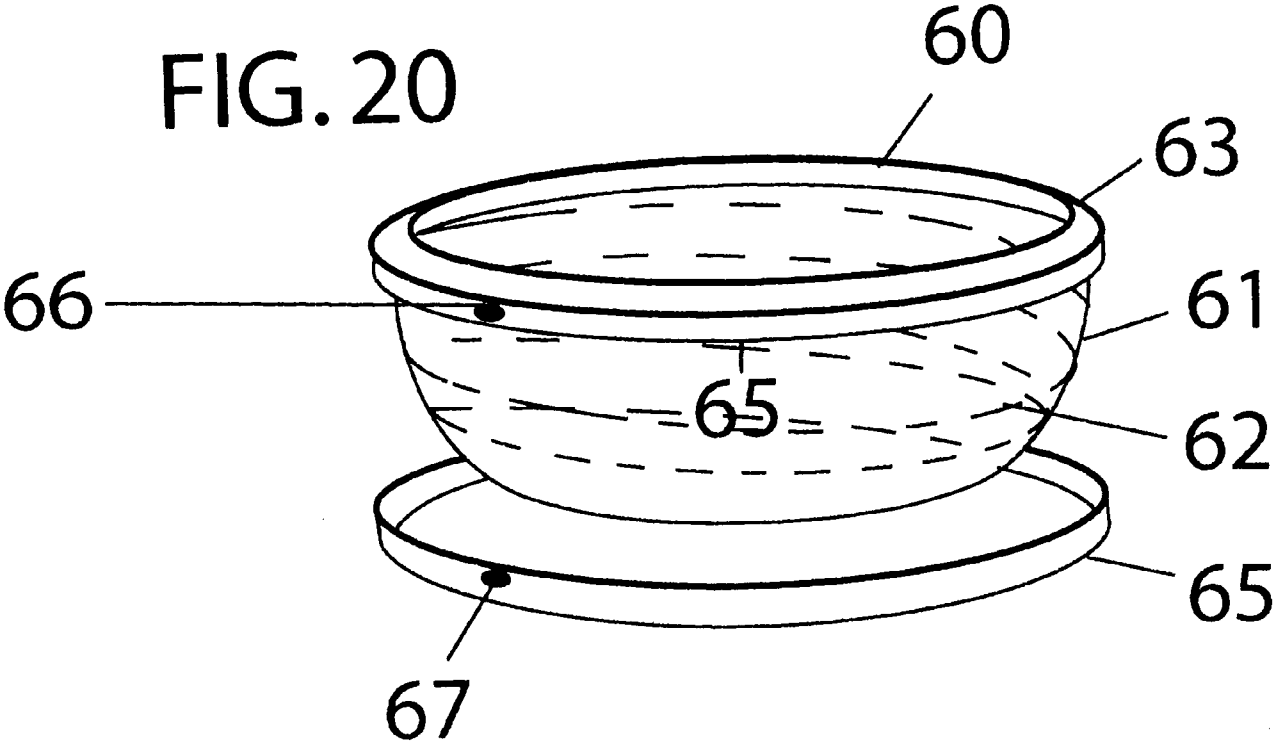
FIG. 20 is a view of a food-container utilizing the principles of the present invention.

In FIG. 20 I have shown the same principle applied to a food container 60 in which the wall 61 has a helical corrugation 62 molded therein between an upper rim 63 and a base member 64 which is received in the apron 65 of the rim and in which similar catches 66, 67 can be provided as were used in the embodiments of FIGS. 1–9 to hold the container in the closed position. Only a very slight relative twist is required to engage or disengage the catches. Other shapes are of course also possible for the food container and a variety of lids can be provided, either permanently secured to member 63 or adapted to fit over the rim 63 as, for example, with certain lids for containers marketed under the trademark "TUPPERWARE".

In both embodiments of the invention, the bottom member 10 or 65, the wall 11 or 61, the rim member 23 or 63 and any lid (e.g. 21) can be embossed or otherwise provided with promotional indicia. Furthermore, in both embodiments the rim member 23 or the bottom member 10, although generally flat, is designed to fit within the other member in the collapsed state of the receptacle.

I claim:

1. A collapsible receptacle comprising:

a generally flat bottom member;

a memory-retentive intrinsically resilient molded one-piece cup-shaped body having a bottom connected to said bottom member, a collapsible wall extending upwardly from said bottom member to a mouth of the cup-shaped body in an erect state of said cup-shaped body;

a rim surrounding said mouth and connected to said wall;

a cover member fitting removably over said mouth and said rim; and a catch formed on said members for releasably locking said cover member to said bottom member in a collapsed state of said receptacle and enabling said wall to spring erect upon release of said catch.

2. The collapsible receptacle defined in claim 1 wherein said members fit one within another in said collapsed state of the receptacle.

3. The collapsible receptacle defined in claim 1 wherein said cup-shaped body is composed of an elastomer.

4. The collapsible receptacle defined in claim 1 wherein said wall is a membrane of a synthetic resin material.

5. The collapsible receptacle defined in claim 1, wherein said cover member seals to said rim and closes said mouth.

6. The collapsible receptacle defined in claim 5 wherein the receptacle is a drinking cup and said wall tapers inwardly from said rim to said bottom member.

7. The collapsible receptacle defined in claim 6, further comprising a closable opening formed in said cover member through which a beverage in said cup can be imbibed.

8. The collapsible receptacle defined in claim 1 wherein said wall is formed with a helical corrugation for ordered collapse of said wall.

9. The collapsible receptacle defined in claim 1 wherein said bottom member is formed with an upwardly extending wall receivable in a downwardly extending apron formed on said cover member.

10. The collapsible receptacle defined in claim 9 wherein said catch includes projections on said apron and an L-shaped recess formed in said upwardly-extending wall of said bottom member projections to form bayonet connections therewith.

11. The collapsible receptacle defined in claim 6 wherein at least one of said cover member, said wall, said rim and said bottom member is provided with promotional indicia.

12. The collapsible receptacle defined in claim 1 in the form of a closable food-storage receptacle and wherein said members are geometrically similar and noncircular.

13. The collapsible receptacle defined in claim 12 wherein one of said member is receivable in the other of said members in a collapsed state of the receptacle.

14. The collapsible receptacle defined in claim 12 wherein one of said members is formed with a projection and the other of said members has an L-shaped recess receiving said projection to form said catch as a bayonet connection.

* * * * *